US005431307A

United States Patent [19]

Brown et al.

[11] Patent Number: 5,431,307

[45] Date of Patent: Jul. 11, 1995

[54] DISPENSING PLURAL COMPONENTS

[75] Inventors: Robert L. Brown, Hartville; Max J. Miller, Jr., Suffield, both of Ohio

[73] Assignee: GenCorp Inc., Fairlawn, Ohio

[21] Appl. No.: 296,789

[22] Filed: Aug. 26, 1994

[51] Int. Cl.[6] ..... B65D 37/00

[52] U.S. Cl. ..... 222/135; 222/145.6; 222/214; 222/334; 417/475; 417/476

[58] Field of Search ..... 222/94, 101, 135–137, 222/145, 333, 334, 214; 417/474–476, 478, 477.6, 477.9

[56] References Cited

U.S. PATENT DOCUMENTS

| | | | |
|---|---|---|---|
| 401,950 | 4/1889 | Haussmmann | 417/476 X |
| 2,094,524 | 9/1937 | Busch | 417/476 X |
| 2,865,303 | 12/1958 | Ferrari, Jr. et al. | 417/475 |
| 2,898,859 | 8/1959 | Corneil | 417/476 X |
| 3,187,951 | 6/1965 | Hardman et al. | 222/135 X |
| 3,232,496 | 2/1966 | Rockwell, Jr. et al. | 222/214 X |
| 3,302,832 | 2/1967 | Hardman et al. | 222/145 X |
| 3,437,050 | 4/1969 | Hrdina | 417/475 |
| 3,679,331 | 7/1972 | Kushner | 417/478 |
| 3,935,885 | 2/1976 | Alter | 417/476 X |
| 3,970,120 | 7/1976 | Whitecar | 417/476 X |
| 4,273,260 | 6/1981 | Bush | 222/135 |
| 4,547,136 | 10/1985 | Rothstein | 417/475 |
| 5,215,215 | 6/1993 | Sauer | 222/334 X |
| 5,257,917 | 11/1993 | Minarik et al. | 417/475 |

FOREIGN PATENT DOCUMENTS

| | | | |
|---|---|---|---|
| 2255073 | 10/1992 | United Kingdom | 222/101 |

*Primary Examiner*—Kevin P. Shaver

*Attorney, Agent, or Firm*—Robert F. Rywalski; Jeanne E. Longmuir

[57] ABSTRACT

A pumping apparatus 10 for dispensing multiple component fluid material. The apparatus 10 includes at least first and second flexible tubes. The tubes each have an inlet and an outlet, and each of the inlets is supplied with a different component of the fluid material. A roller or rollers are provided for pressurized engagement with the tubes. The stop plate is engaged with the tubes at a location opposing the pressurized engagement of the roller. A driver mechanism independently moves the roller in pressurized engagement with the tubes, opposed by the stop plate, in a linear direction. Such linear movement carries the desired and variable amounts of fluid material to the tube outlets. An engagement frame supports the tubes, roller, stop plate and driver mechanism. A mixing reservoir is provided having multiple inlets, each of which is engaged with a flexible tube outlet, and a single outlet, such that the fluid material components are combined within the mixing reservoir and provided to the single outlet. A static mixer may also be provided which is supplied with mixed fluid material via the single outlet of the mixing reservoir for further mixing of the components of the fluid material.

20 Claims, 13 Drawing Sheets

DISPENSING PLURAL COMPONENTS

TECHNICAL FIELD

The present invention relates to an apparatus for dispensing fluid material, and more particularly to a pump for dispensing multiple material components in predetermined ratios.

BACKGROUND OF THE INVENTION

Currently available dispensing devices for dispensing fluid material, and in particular multiple component adhesive materials, in predetermined desired ratios often use a conventional cartridge type dispenser which includes a piston engaged within the cartridge to dispense the desired amount of fluid. Such devices are often used in connection with the mixing of multiple component reactive materials containing volatile organic compounds or VOC's. Unfortunately, such devices have a tendency to leak, and do not provide consistent repeatable shot sizes of each of the material components.

Further, such prior art devices typically do not pump the different adhesive material components in various ratios or desired amounts. As a result, premixing of the separate components in the desired formula is required prior to pumping. Such premixing exposes the pump operator to component materials which may give off undesirable fumes, and which are difficult to clean up in the event a spill occurs during the premixing operation. Additionally, the premixing of such materials also results in an increased amount of waste product due to the reduced life of the materials once exposed, for example in open containers, for mixing.

Available prior art devices also do not allow the material components being pumped to be changed to different materials, without further cleaning of the devices. Moreover, the devices typically force the component materials from their respective cartridges under pressure. Such pressurized application can additionally result in leakage and inconsistent shot sizes of the desired component materials being applied. Although attempts have been made to deliver such material components individually using a fixed gear ratio assembly, such fixed gear ratio devices do not maintain the desired ratios of component materials for materials having different viscosities.

SUMMARY OF THE INVENTION

The present invention provides a new and improved dispensing apparatus or pump for dispensing multiple material components in predetermined ratios. The pump is preferably small in size, and has several operating advantages over the prior art.

The present pump is leak proof, and the component materials are not applied under pressure. The pump is designed to permit individual pumping of the component materials directly from their package containers. Such delivery avoids wasteful and potentially hazardous mixing of the component materials prior to providing them to the pump, since the problems relating to shortened life of materials due to mixing, as well as exposure to material fumes are reduced.

The pump is also designed to avoid contact between the material components being dispensed, and the mechanical parts of the pump. This type of design reduces the pump maintenance required due to material interference. By eliminating leakage, the need to apply the component materials under pressure, and problems with the pump due to contact between component materials and moving parts of the pump, the dispensing apparatus is able to achieve a high repeatability of shot size. Also, the pump apparatus is designed to enable adjustment of the shot size to obtain variable application ratios of each of the different component materials, and to maintain the specific ratios independent of the shot size and material viscosity.

In order to rapidly change the materials being pumped by the dispensing apparatus, the apparatus is provided with disposable parts which enable each of the parts in contact with the component materials to be removed and disposed of, for replacement by other parts of the same or an alternate desired size. This replacement feature also enables rapid replacement in the event of contamination of the component materials within the apparatus. Such contamination prevention features are often important in certain types of applications, such as in the medical or aerospace field.

The apparatus for dispensing fluid materials with at least two components includes, flexible tubes, pinch rollers, a stop plate, and a driver mechanism for moving the pinch rollers. Each of the flexible tubes has an inlet to supply material to the pump, and an outlet to dispense materials from the pump in the desired ratio or amount. The roller engages the tube in a pinched or compressed condition, and is moved along the tube to squeeze the desired amount of fluid component material from the tube outlet to the mixing reservoir. Further, the stop plate engages the tube at a location opposite the location where the tube is engaged by the pinch roller.

The driver mechanism moves the roller in the described compressed engagement with the tube which is opposed by the stop plate, in order to move the fluid material through the tube outlet. The driver mechanism also engages the stop plate, and moves the stop plate into and out of engagement with the flexible tubes when the pinch rollers are engaged with the tubes. An engagement frame supports the flexible tube, pinch rollers, stop plate and driver mechanism. By coupling the driver mechanisms, preferably electronically, the ratios and shot sizes of the component materials are maintained despite any differences in material viscosity.

Following dispensing from the flexible tubes, the fluid component materials are provided to a mixing reservoir. The mixing reservoir has at least one inlet and an outlet. The mixing reservoir inlet or inlets are engaged with the outlets of the flexible tubes to mix the fluid material component within the mixing reservoir before providing it to the mixing reservoir outlet.

From the mixing reservoir outlet, the mixed component materials are supplied, via the outlet of the mixing reservoir, to a mixer for mixing the fluid materials before they are dispensed to the desired location.

The driver mechanism may also include a plate driver mechanism which engages the stop plate. In the event a plate driver mechanism is provided, it moves the stop plate into and out of engagement with the flexible tubes when the pinch rollers are engaged with tubes. When the flexible tubes are pinched by the pinch rollers, which are moved by the drive mechanism, the fluid component materials are moved along within the tubes in the desired amounts.

Other features and advantages of the present dispensing apparatus will become apparent from the following detailed description of the preferred embodiments made with reference to the accompanying drawings, which form a part of the specification.

DETAILED DESCRIPTION OF THE PREFERRED EMBODIMENTS

Figure 1:
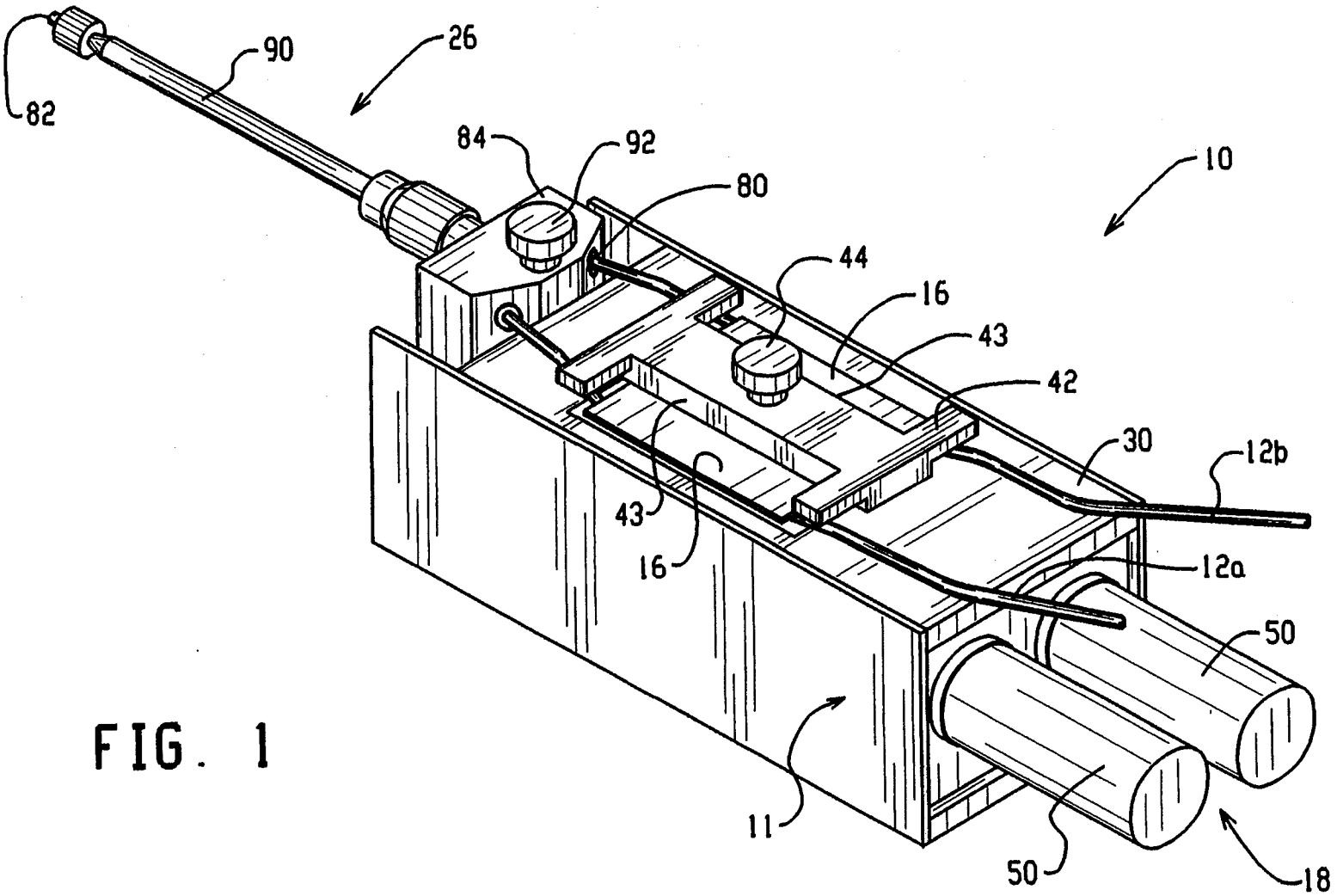
FIG. 1 is a perspective, exploded view of a preferred embodiment of the dispensing apparatus constructed in accordance with this application.
Figure 2:
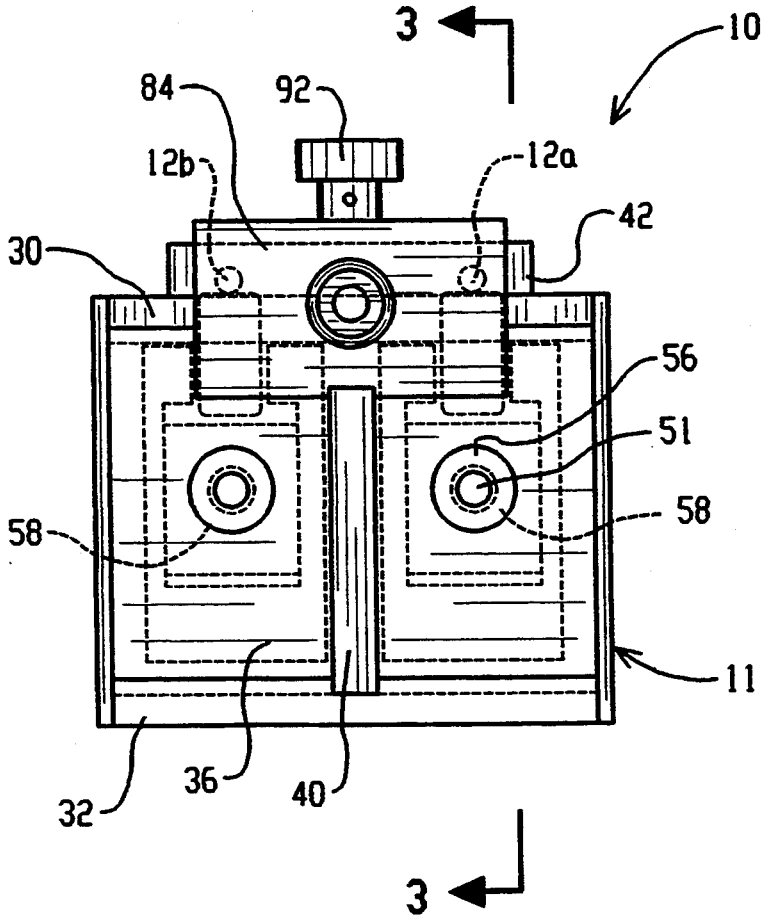
FIG. 2 is a schematic, cut-away front end view of the embodiment of the dispensing apparatus, taken along the line 2—2 of FIG. 3.

FIGS. 1–6 illustrate a first preferred embodiment of the dispensing apparatus of the present application for applying a desired amount of fluid material consisting of at least two component materials which are mixed in the desired amounts or ratios. The dispensing apparatus or pump, generally referred to at reference numeral 10, preferably includes flexible tubes 12*a*, 12*b*, rollers or pinch rollers 14*a*, 14*b*, a stop plate 16, and a driver mechanism 18. The driver mechanism 18 moves the pinch rollers 14*a*, 14*b* into engagement with the stop plate 16 to pinch the flexible tubes 12*a*, 12*b* during movement of the pinch rollers.

Each of the flexible tubes 12*a*, 12*b* has an inlet 20 to supply material to the pump 10, and an outlet 22 to dispense material from the pump in the desired ratio or amount to a mixing reservoir 26. Each pinch roller 14*a*, 14*b* is positioned to engage its respective tube 12*a*, 12*b*, and to pinch or compress the tube when the stop plate 16 engages the tube. In the illustrated embodiment of FIGS. 1–4, the stop plate 16 is spring sheet metal having a substantially square shape. The stop plate 16 engages the tubes 12*a*, 12*b* at locations opposite the locations where the tube is engaged by the pinch roller 14*a*, 14*b*.

Figure 3:
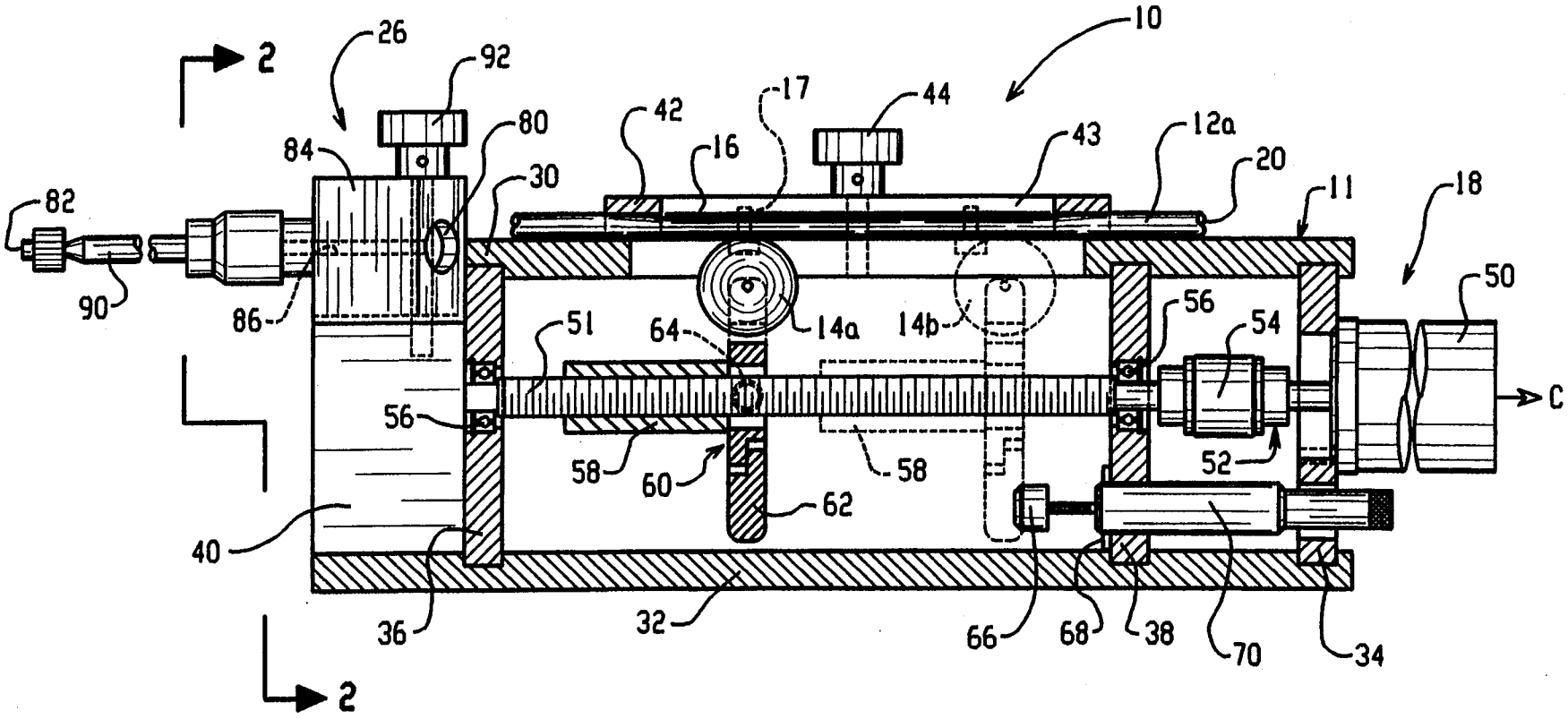
FIG. 3 is a schematic, cut-away side view of the embodiment of the dispensing apparatus, taken along the line 3—3 of FIG. 2.
Figure 4:
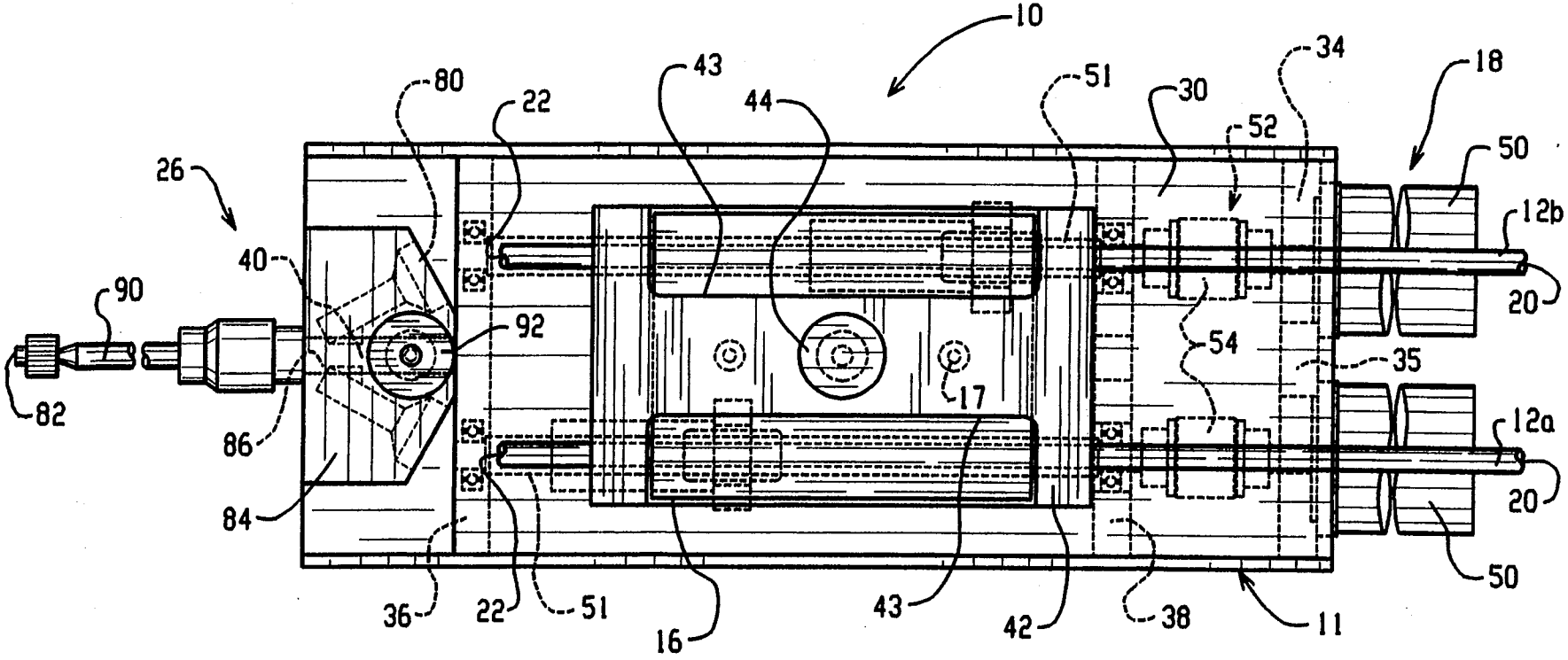
FIG. 4 is a schematic, cut-away top view of the embodiment of the dispensing apparatus of FIG. 3.

An engagement frame 11 supports the flexible tubes 12*a*, 12*b*, pinch rollers 14*a*, 14*b*, stop plate 16 and driver mechanism 18. The engagement frame 11 comprises a top plate 30, a bottom plate 32, a front plate 34, a front post 35, a back plate 36, and a middle plate 38, which are interconnected to form a frame supporting the apparatus 10 components. Additionally, a back post 40 supports the mixing reservoir 26 adjacent the back plate 36. The stop plate 16 is maintained in position for engagement with the flexible tubes under pressure of the rollers 14*a*, 14*b* using a dog bone clamp 42. As shown in FIGS. 3 and 4, the dog bone clamp 42 is supported on the top plate 30, with the stop plate 16 located under the top plate. The stop plate 16 is secured to the dog bone clamp 42 by conventional fasteners 17. The flexible tubes 12*a*, 12*b* are engaged under the stop plate 16 and the dog bone clamp 42.

The dog bone clamp 42 includes cut-outs 43 so that during engagement of the rollers 14*a*, 14*b* with the stop plate 16, the spring sheet metal may flex in the general area of the cut-outs. The flexing permits pinching of the flexible tubes 14*a*, 14*b*, without collapsing the tubes. The dog bone clamp 42 secures the flexible tubes in position using a threaded clamping knob 44. Using this arrangement, the flexible tubes are removably captured under the stop plate 16. When it is desired to replace the flexible tubes, whether for cleaning or changing purposes, the clamping knob 44 is disengaged from the dog bone clamp, and the clamp and stop plate 16 may be removed to provide open access to the flexible tubes.

In the embodiment illustrated in FIGS. 1–4, the driver mechanism 18 includes first and second roller drivers 23*a*, 23*b*. The illustrated roller drivers are powered by servo-mechanisms 50 which are digitally interconnected to enable each roller driver to operate at a different acceleration rate. Such interconnection enables the proper material component ratios to be independently maintained, regardless of any differences in the viscosities of the material components. In the illustrated embodiment, the servo-mechanisms are preferably Yaskawa SGM Servomotors. In order to drive the rollers 14*a*, 14*b* at different rates to obtain a mix of different ratios of fluid material, each of the roller drivers should be capable of operating at an acceleration rate independent from the other. Each of the servo-mechanisms may be interconnected with a system controller C, which may be used to control the speed of operation of the driver mechanism 18, and thus the dispensing rate of the fluid component materials exiting the dispensing apparatus 10. Alternatively, manual setting of the servo-mechanisms is possible. It would be understood by one of ordinary skill in the art that servo-mechanisms, air motors or electric motors may likewise be used for the driver mechanisms described in the present application.

The roller drivers 23*a*, 23*b* are each interconnected with a shaft 51 which supports the respective pinch rollers 14*a*, 14*b*, via a flexible coupling 52 covered by a sleeve 54. The illustrated interconnected threaded shaft 51 is supported on one end within the middle plate 38 by a conventional ball bearing 56, and on the opposite end within the back plate 36 by a conventional ball bearing. The shafts 51 each support a pinch roller 14*a*, 14*b* engaged with a conventional ball screw nut 58. In the illustrated embodiment, the ball screw nuts 58, available from Thomson Saginaw, are in threaded engagement with the respective shafts 51.

The illustrated pinch rollers 14*a*, 14*b* are preferably pivotable at a pivot location 64 where an arm 60 supports each of the pinch rollers engaged with the ball screw nuts 58. The arm 60 includes a lock portion 62 to enable the pinch rollers 14*a*, 14*b* to maintain a vertical position during movement of pinch rollers in the direction from the middle plate 38 to the back plate 36.

As shown in FIG. 3, the pinch rollers are moved from the middle plate to the back plate at different rates. The variable movement permits different volumes of fluid material to be provided to the mixing reservoir from each of the flexible tubes 12*a*, 12*b*.

During movement of the pinch rollers 14*a*, 14*b* in a direction toward the back plate 36, the tubes are engaged with the stop plate 16. The rollers compress the tubes to squeeze the fluid component material within each tube and move the material along within each tube in the desired amount. The desired amount of component material is thus provided from each tube outlet 20 to the mixing reservoir 26.

Upon completion of the desired travel stroke of the rollers 14*a*, 14*b*, the rollers are returned to their starting position adjacent the middle plate 38. When moving in the direction of the middle plate 38, the pinch rollers 14*a*, 14*b* are pivoted out of engagement with the flexible tubes at the pivot location shown in FIG. 3. Once the rollers are returned to the starting position, the lock portion 62 of the arm 60 contacts a stop member 66. The stop member 66 is interconnected with a check valve 68 and hydraulic shock absorber 70, which are supported within the middle plate 38 and front plate 34. The stop member, check valve and shock absorber 66, 68, 70 serve to cushion the return engagement of the pinch rollers to the starting position, and to return the arm 60 and pinch rollers 14*a*, 14*b* to the upright position using the lock portion 62. Upon engagement of the lock portion 62 with the stop member 66, the pinch roller is ready for the next compression of the flexible tubes.

Figure 5:
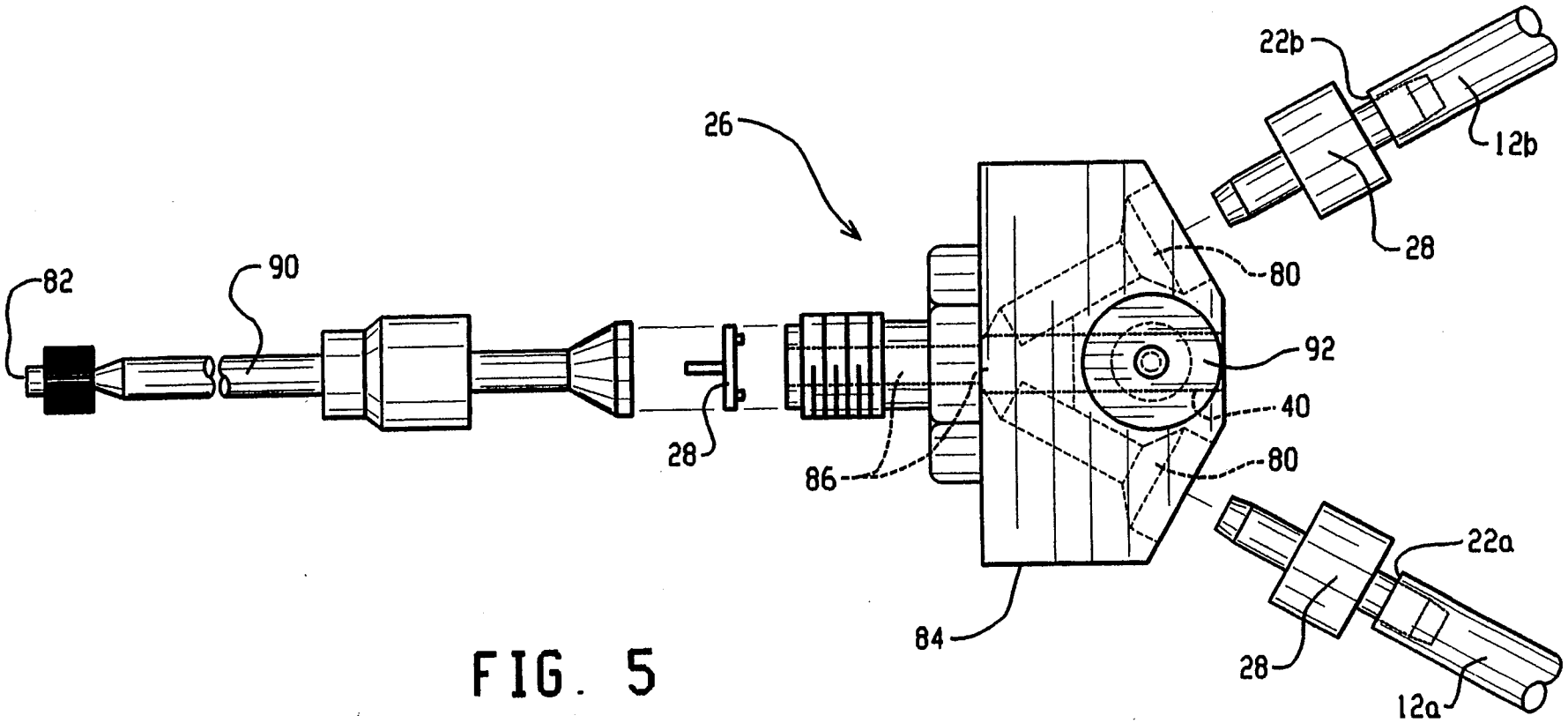
FIG. 5 is an exploded schematic view of the mixing reservoir of one embodiment of the dispensing apparatus of FIG. 3.
Figure 6:
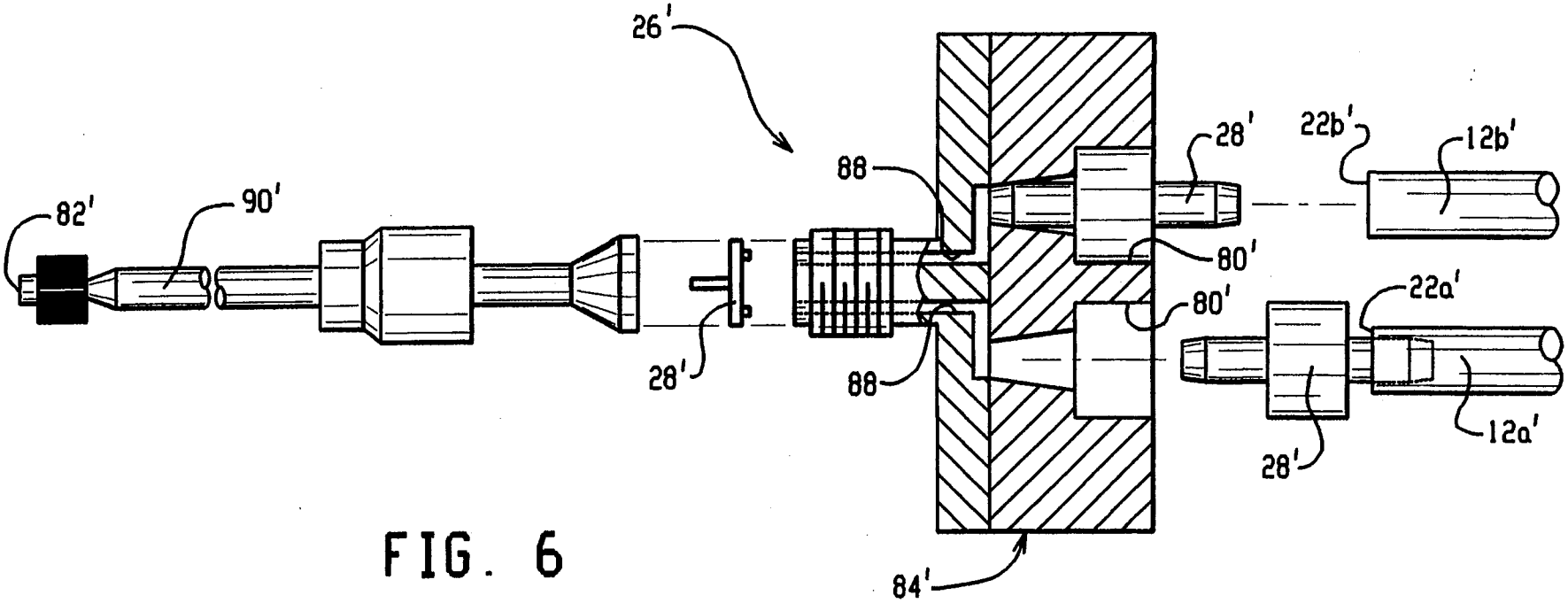
FIG. 6 is an exploded schematic view of the mixing reservoir of another embodiment of the dispensing apparatus.
Figure 7A:
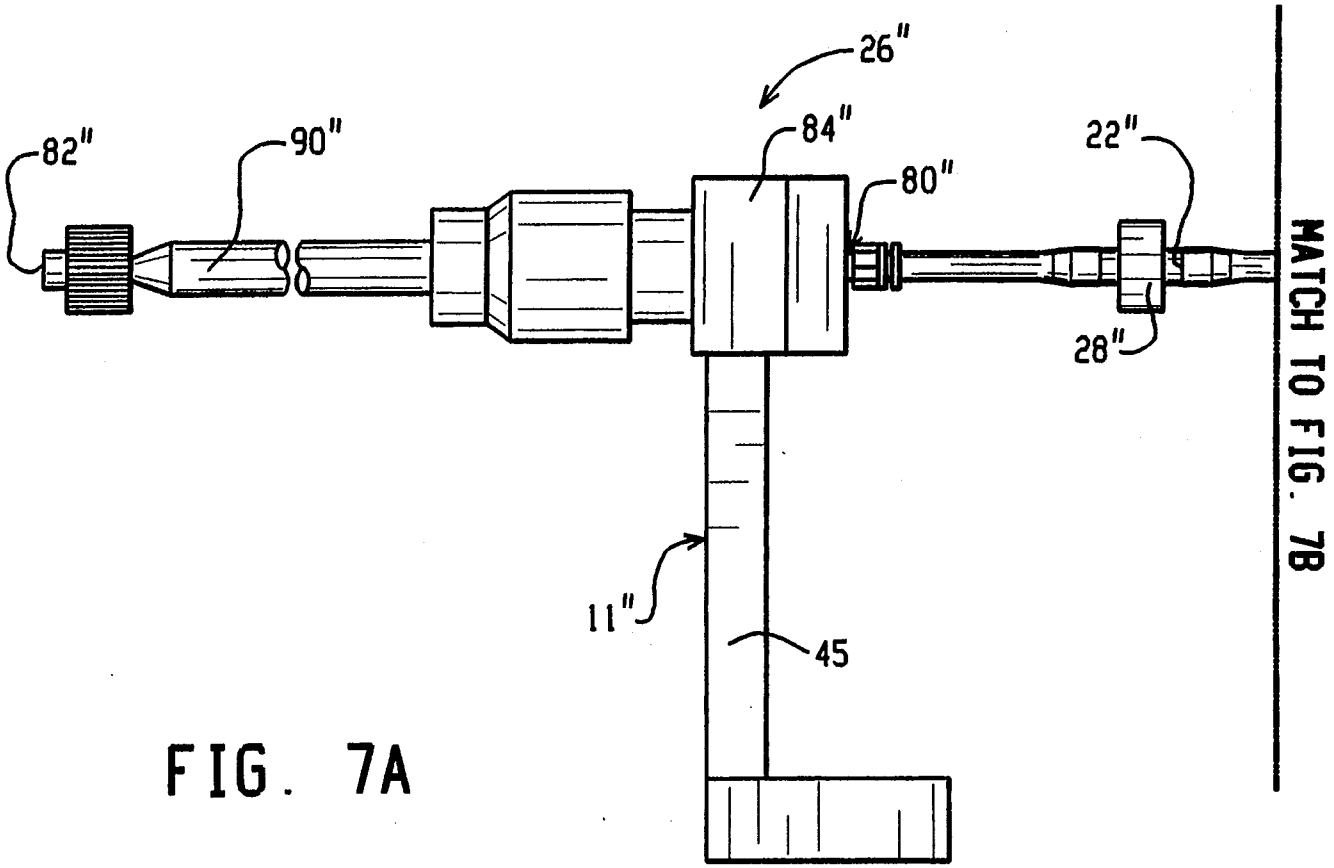
FIGS. 7A and 7B are cut-away, side views of another embodiment of the dispensing apparatus constructed in accordance with this application.
Figure 7B:
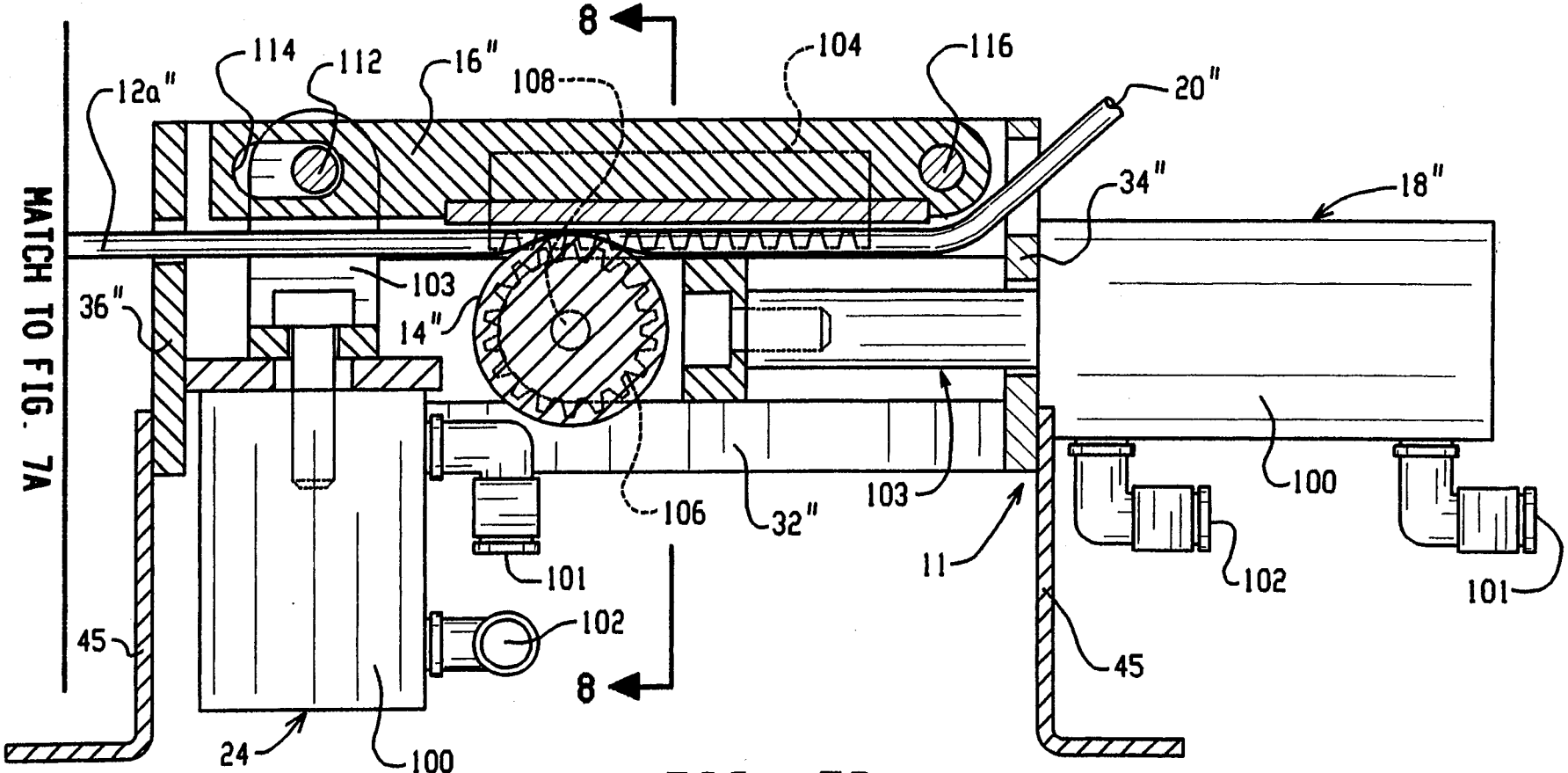
Figure 8:
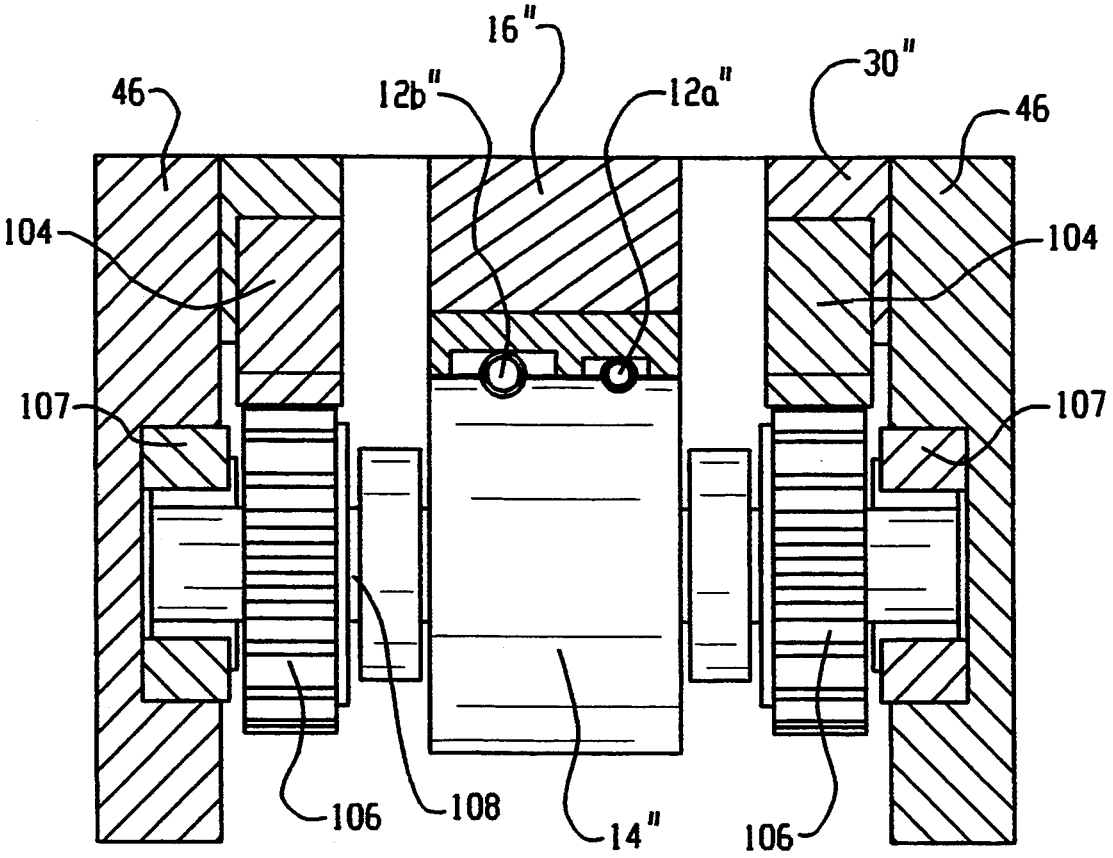
FIG. 8 is a cut-away, side view of the embodiment of the dispensing apparatus of FIGS. 7A and 7B, taken along the line 8—8.
Figure 9:
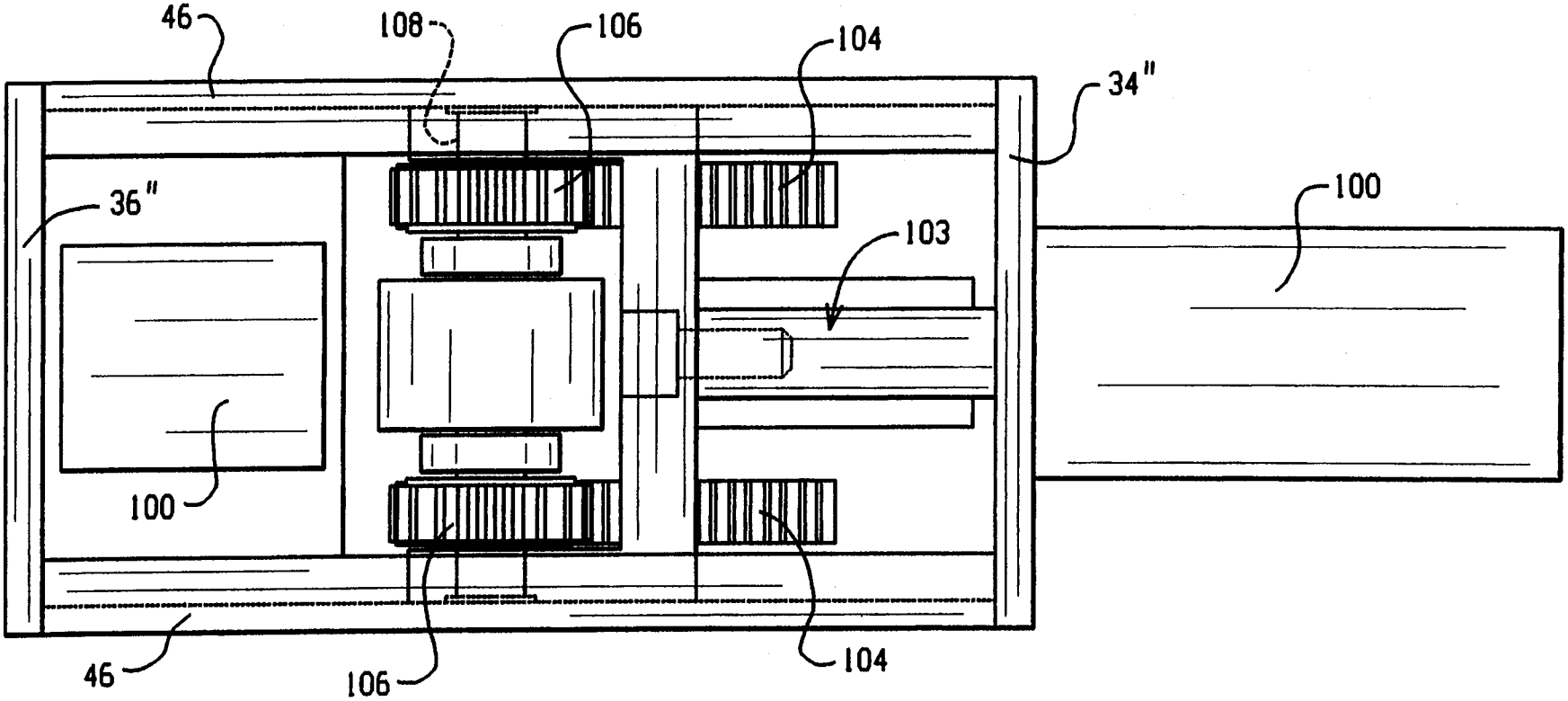
FIG. 9 is a schematic, bottom view of the embodiment of the dispensing apparatus of FIG. 7B.

Alternate embodiments of the mixing reservoir 26 are illustrated in FIGS. 5 and 6, where the components of the reservoir are identical they will be referred to using the same reference numeral, and only the differences between components will be discussed further. The mixing reservoir has at least one inlet 80 and an outlet 82. The mixing reservoir inlet or inlets 80, 80' are engaged with the outlets 22*a*, 22*b* of the flexible tubes. In the illustrated embodiment, check valves 28, 28' are provided to prevent the reverse flow of fluid material. The check valves 28, 28' are engaged with the inlets 80, 80' formed in an adaptor block 84. In the embodiment of FIG. 5, the adaptor block 84 includes a central passageway 86 which receives fluid material from both the inlets 80. In FIG. 6, the illustrated embodiment of the adaptor block 84' includes dual passageways 88, one from each of the inlets 80'. The adaptor block 84, 84' is secured to the back post 40 of the engagement frame 11 using a threaded adaptor clamping knob 92.

Both passageways 86, 88 are provided to a still further check valve 28 to prevent reverse flow, and then to a mixer 90 for mixing the fluid materials before they are dispensed to the desired location. The mixer 90 may further include a static mixing mechanism for mixing the fluid materials, as desired.

FIGS. 7A–10C illustrate an alternate embodiment of the dispensing apparatus 10'. As this alternate embodiment of the apparatus 10' has components similar to those previously described, the similar components will be referred to using the same names and reference numerals, but with a double prime designation. Only the differences between this modified embodiment and the previously described embodiment will be discussed in further detail.

The engagement frame 11" supports the alternate embodiment legs 45. Additionally, the front and back plates 34", 36" are engaged with supporting side plates 46.

In the alternate embodiment, variable amounts of fluid material components are obtained from each of the flexible tubes 12*a"*, 12*b"* using tubes having internal diameters of different dimensions. As illustrated, the tubes may be of any desired diameter in order to obtain the necessary ratio of component materials.

The driver mechanism 18" which operates the single pinch roller 14" of this embodiment, includes an air motor 100, having an input 101 and an output 102, driven by compressed air. The air motor 100 is supported on the front plate 34", and is interconnected with a plunger 103, which is interconnected with the axel 108 to drive the gears 106 along their respective racks 104. The compressed air is preferably supplied via a conventional manufacturing plant supply. Each of the air motors 38, 58 may be interconnected with a system controller C, which may be used to control the speed of operation of the driver mechanism, and thus the dispensing rate of the component material exiting the dispensing apparatus 10. Alternatively, manual setting of the air motors is possible.

The driver mechanism 18" also includes gear racks 104 engaged with the top plate 30" of the engagement frame 11" for engagement with gears 106. The gears 106 are supported by bearings 107 in the side plates 46, on a common axle 108 with the roller 14". The gears 106 are moved along the respective racks 104 by the air motor 100 to pump a variable volume of fluid material component from each of the flexible tubes 12*a"*, 12*b"* to the mixing reservoir 26". Again, the amount of fluid material component provided to the mixing reservoir is based upon the internal diameter dimensions of the flexible tubes 12*a"*, 12*b"*.

Figure 10A:
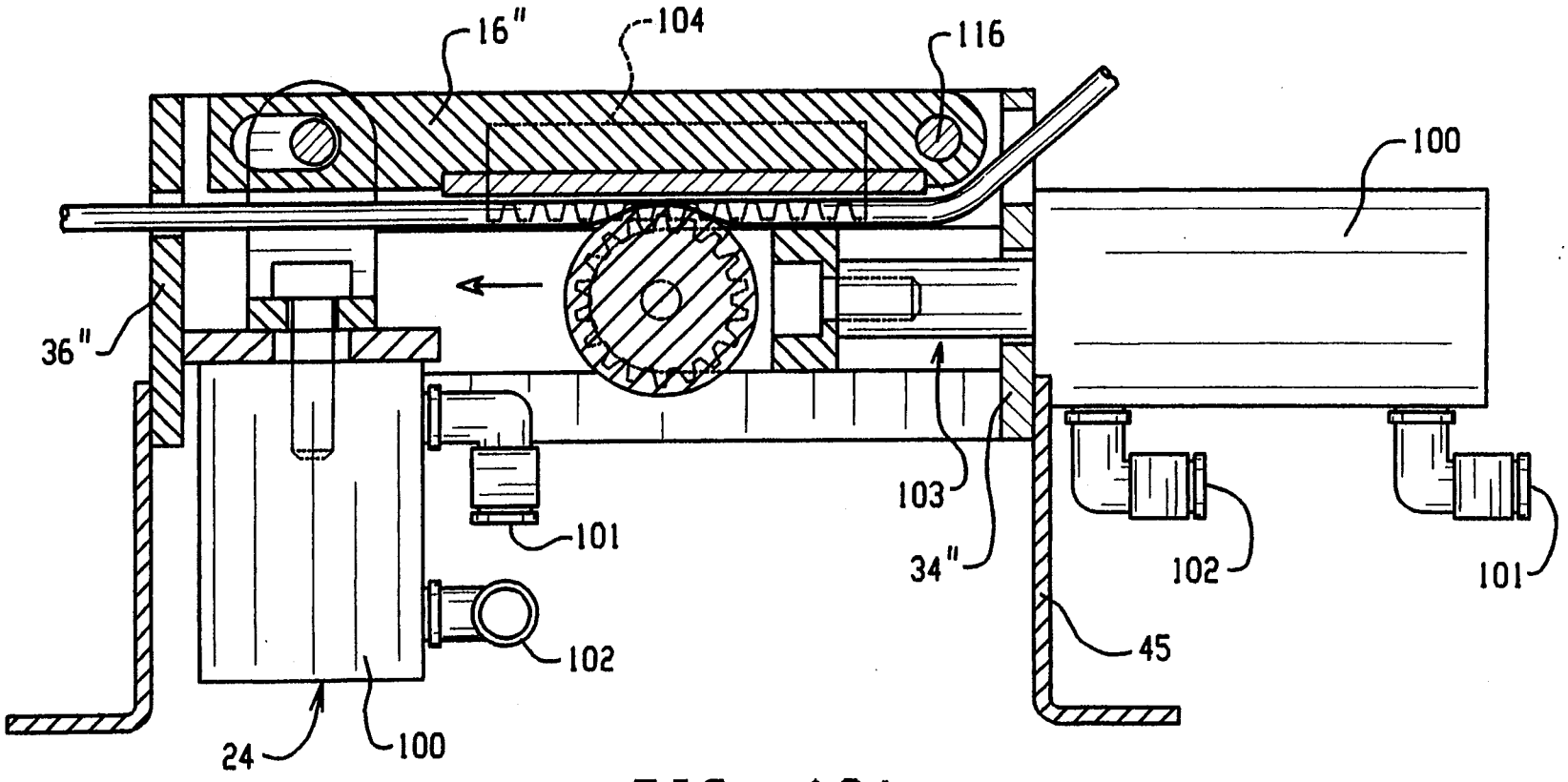
FIG. 10A is a schematic, cut-away view of the driver mechanism of the embodiment of the dispensing apparatus of FIG. 7B shown in the dispensing position and moving in the direction of the arrow illustrated.

During travel of the roller 14" in the direction of the arrow illustrated in FIG. 10A, the flexible tubes 12*a"*, 12*b"* are in pressurized engagement with the stop plate 16". Upon completion of travel of the gears 106 along the rack 104, the stop plate 16" is moved out of engagement with the flexible tubes 12*a"*, 12*b"* to enable unpressurized return of the roller 14" to the starting position adjacent the front plate 34", in the direction of the arrow shown in FIG. 10C.

Figure 10B:
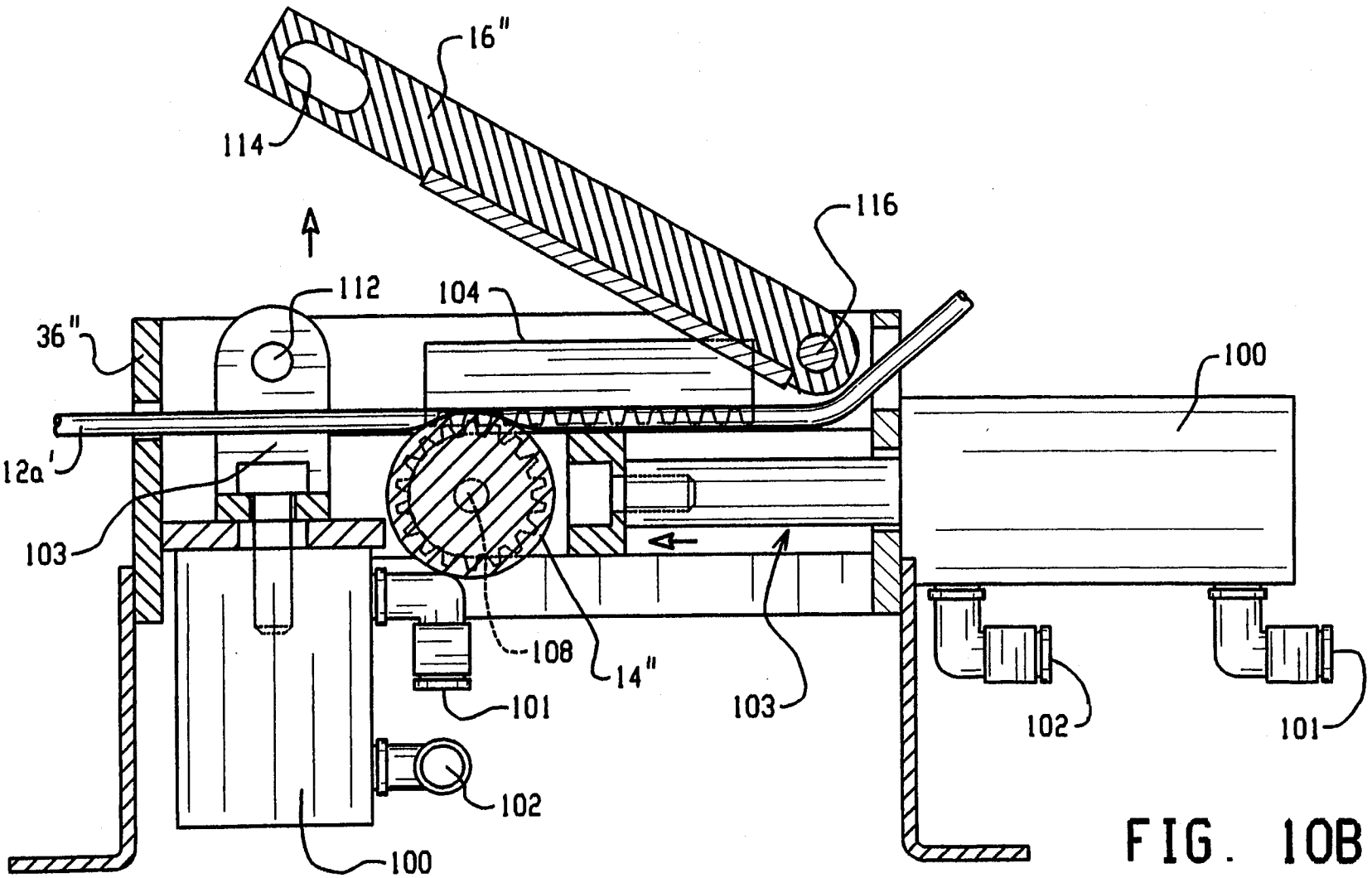
FIG. 10 is a schematic, cut-away view of the driver mechanism of the embodiment of the dispensing apparatus of FIG. 7B shown in the open position where the driver mechanism has completed the length of the stroke, is opened and is positioned to return to the starting position for an additional position.
FIG. 10C is a schematic, cut-away view of the driver mechanism of the embodiment of the dispensing apparatus of FIG. 7B shown in the closed position following return of the driver mechanism to the starting position prior to additional processing.
Figure 10C:
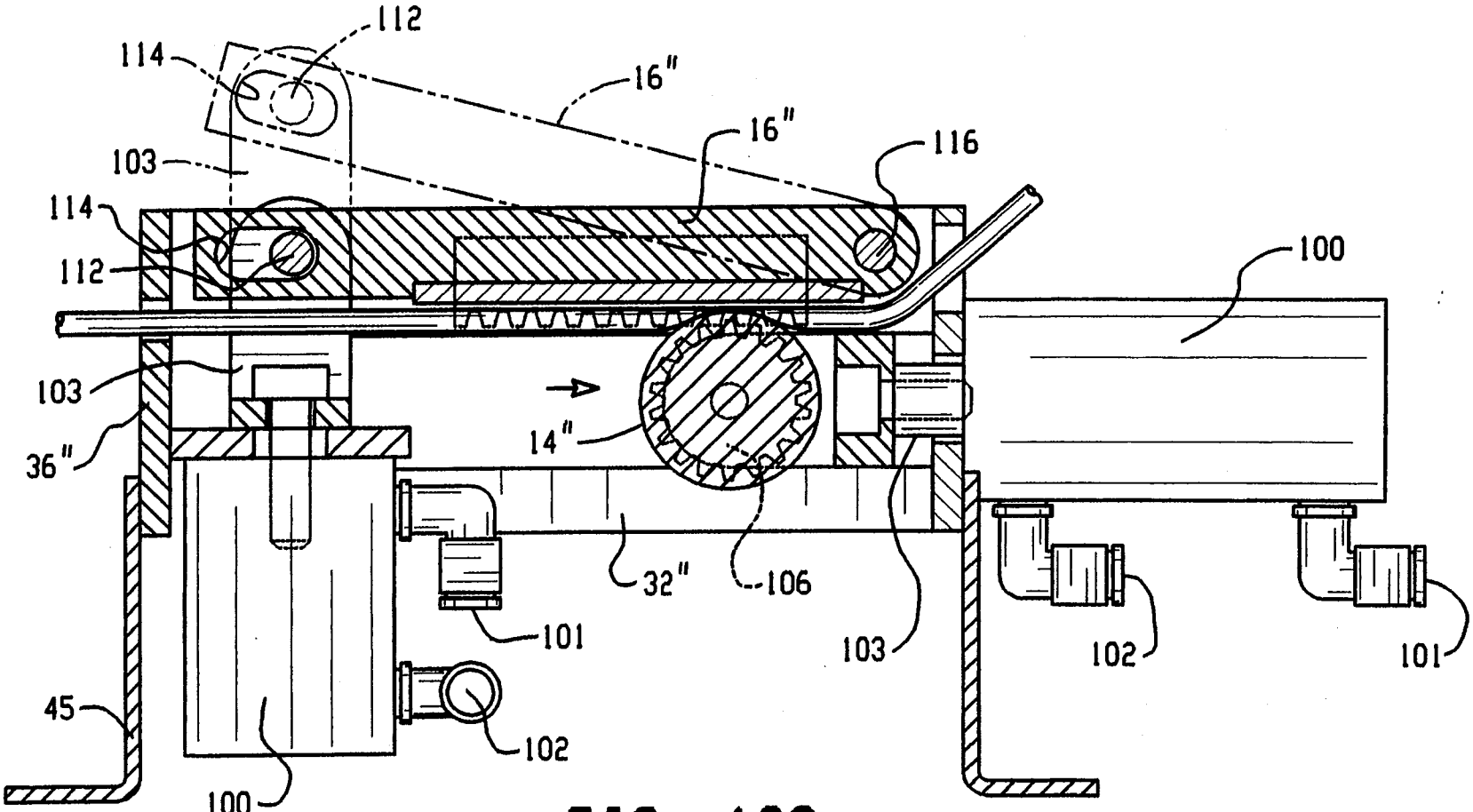

The stop plate 16" is moved out of engagement with the flexible tubes 12*a"*, 12*b"* to the position shown in phantom in FIG. 10C by a plate driver mechanism 24. In the illustrated embodiment, the plate driver mechanism 24 is an air motor 100 identical to that previously described in connection with the driver mechanism 18". The plate driver mechanism air motor 100 is supported on the back plate 36", and is interconnected with a vertical plunger 103 having a pivot axle 112, which is interconnected with a pivot opening 114 in the stop plate 16". During movement of the axel 108 to drive the gears 106 along their respective racks 104 to the starting position, the stop plate 16" pivots out of engagement with the tubes at a front pivot 116. It is noted that the stop plate 16" may be completely removed from engagement with the plunger 103, as shown in FIG. 10*b*, in the event it is desired to remove, replace and/or clean the flexible tubes 12*a*″, 12*b*″.

Once the roller 14″ has returned to the starting position, the stop plate 16″ is returned to the solid line position of FIG. 10C for the next travel operation. As previously described, the driver mechanism 18″ moves the pinch roller 14″ in the described compressed engagement with the flexible tubes which is opposed by the stop plate 16″, in order to move the fluid material components through the tubes.

Following dispensing from the flexible tubes 12*a*″, 12*b*″, the fluid component materials are provided to a mixing reservoir 26 as previously described.

The preferred forms of the dispensing apparatus 10, 10′ have been described above. However, with the present disclosure in mind it is believed that obvious alterations to the preferred embodiment, to achieve comparable features and advantages in other assemblies, will become apparent to those of ordinary skill in the art.

We claim:

1. An apparatus for dispensing a fluid material, said pump comprising:

a flexible tube having an inlet and an outlet, said inlet supplied with said fluid material;

a roller for pressurized engagement with said tube;

a stop plate for engagement with said tube at a location to oppose the pressurized engagement of said roller when said roller is engaged with said tube;

a driver mechanism for moving said roller in pressurized engagement with said tube, opposed by said stop plate moving said fluid material to said tube outlet at said roller rate of travel;

an engagement frame for supporting said flexible tube, roller, stop plate and driver mechanism; and a mixing reservoir having an inlet and an outlet, wherein said reservoir inlet is engaged with an outlet of said flexible tube and said fluid material component is mixed within said mixing reservoir before being provided to said outlet.

2. The apparatus of claim 1, further comprising a mixer supplied with mixed fluid material via said outlet of said mixing reservoir and mixing said fluid material before providing said fluid material to a desired location.

3. The apparatus of claim 1, wherein said roller is moved in a linear direction.

4. The apparatus of claim 1, wherein said driver mechanism further includes a plate driver mechanism engaged with said stop plate and moving said stop plate into and out of engagement with said flexible tube when said roller is engaged with said tube.

5. The apparatus of claim 4, wherein said tube is supported in a fixed position engaged by said stop plate and roller.

6. A pumping apparatus for dispensing a multiple component fluid material, said pump comprising:

at least first and second flexible tubes, each having an inlet and an outlet, each of said inlets supplied with a component of said fluid material;

a roller for pressurized engagement with said tubes;

a stop plate for engagement with said tubes at a location opposing the pressurized engagement of said roller when said roller is engaged with said tubes;

a driver mechanism moving said roller independently and at different rates, in pressurized engagement with said tubes, opposed by said stop plate, to move said fluid material to said tube outlets;

an engagement frame for supporting said tubes, roller, a stop plate and driver mechanism, and wherein said tubes are supported in a fixed position for engagement by said stop plate and roller;

a mixing reservoir having multiple inlets and a single outlet, wherein each of said reservoir inlets is engaged with an outlet of one of said flexible tubes and said fluid material components are combined within said mixing reservoir and provided to said single outlet; and a mixer supplied with mixed fluid material via said single outlet of said mixing reservoir for further mixing said components of said fluid material and providing said fluid material to a desired location.

7. The apparatus of claim 6, wherein said roller is moved in a linear direction.

8. The apparatus of claim 7, wherein said mixer is a static mixer.

9. The apparatus of claim 6, wherein said flexible tubes have internal diameters of different dimensions, and said driver mechanism includes a gear rack mounted on said engagement frame for engagement with gears supported on a common axle with said roller, and said gears are moved along said rack by said driver mechanism and pump a variable volume of fluid material components from each of said flexible tubes to said mixing reservoir based upon said internal diameter dimensions of said flexible tubes.

10. The apparatus of claim 6, wherein said driver mechanism includes a driver to drive said roller mounted on support rods engaged with said engagement frame to pump a variable volume of fluid material component from each of said flexible tubes to said mixing reservoir at said roller rate of travel.

11. The apparatus of claim 9, further comprising a plate driver mechanism engaged with said stop plate for moving said stop plate into and out of engagement with said flexible tubes when said roller are engaged with said tubes.

12. The apparatus of claim 11, wherein said plate driver mechanism comprises an air cylinder for vertically moving said stop plate into engagement with said tubes.

13. The apparatus of claim 12, wherein said stop plate is vertically moved by an air cylinder into engagement with said tubes.

14. A pumping apparatus for dispensing a multiple component fluid material, said pump comprising:

at least first and second flexible tubes, each having an inlet and an outlet, each of said inlets supplied with a component of said fluid material;

a roller for pressurized engagement with said tubes;

a stop plate for engagement with said tubes at a location opposing the pressurized engagement of said roller when said roller is engaged with said tubes;

a driver mechanism moving said roller in pressurized engagement with said tubes, opposed by said stop plate, in a linear direction and moving said fluid material to said tube outlets;

an engagement frame for supporting said tubes, roller, stop plate and driver mechanism, and wherein said tubes are supported in a fixed position for engagement by said stop plate and roller;

a mixing reservoir having multiple inlets and a single outlet, wherein each of said reservoir inlets is engaged with an outlet of one of said flexible tubes and said fluid material components are combined within said mixing reservoir and provided to said single outlet; and a static mixer supplied with mixed fluid material via said single outlet of said mixing reservoir for further mixing said components of said fluid material before providing said fluid material to a desired location.

15. The apparatus of claim 14, further comprising a plate driver mechanism engaged with said stop plate for moving said stop plate into and out of engagement with said flexible tubes when said roller are engaged with said tubes.

16. The apparatus of claim 15, wherein said flexible tubes have internal diameters of different dimensions, and said driver mechanism includes a gear rack mounted on said engagement frame for engagement with gears supported on a common axle with said roller, and said gears are moved along said rack by said driver mechanism and pump a variable volume of fluid material components from each of said flexible tubes to said mixing reservoir based upon said internal diameter dimensions of said flexible tubes.

17. The apparatus of claim 14, wherein said driver mechanism includes a driver to drive said roller mounted on support rods engaged with said engagement frame to pump a variable volume of fluid material components from each of said flexible tubes to said mixing reservoir based upon said roller rate of travel.

18. The apparatus of claim 15, wherein said plate driver mechanism comprises an air cylinder for vertically moving said stop plate into engagement with said tubes.

19. The apparatus of claim 18, wherein said stop plate is vertically moved by an air cylinder into engagement with said tubes.

20. The apparatus of claim 17, wherein said flexible tubes, mixing reservoir and mixer are removable from said apparatus for replacement with alternate flexible tubes, mixing reservoirs and mixers.

* * * * *